US011353232B2

(12) United States Patent
Konno

(10) Patent No.: US 11,353,232 B2
(45) Date of Patent: Jun. 7, 2022

(54) CONTROL METHOD, CONTROL APPARATUS, AND NON-TRANSITORY COMPUTER-READABLE STORAGE MEDIUM FOR STORING PROGRAM

(71) Applicant: FUJITSU LIMITED, Kawasaki (JP)

(72) Inventor: Takeshi Konno, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 458 days.

(21) Appl. No.: 16/586,880

(22) Filed: Sep. 27, 2019

(65) Prior Publication Data

US 2020/0124310 A1 Apr. 23, 2020

(30) Foreign Application Priority Data

Oct. 23, 2018 (JP) ..... JP2018-199520

(51) Int. Cl.

| | |
|---|---|
| ***F24F 11/67*** | (2018.01) |
| ***F24F 11/64*** | (2018.01) |
| ***F24F 11/65*** | (2018.01) |
| ***F25B 13/00*** | (2006.01) |
| *F24F 110/10* | (2018.01) |
| *F24F 110/12* | (2018.01) |

(52) U.S. Cl.

CPC ..... *F24F 11/67* (2018.01); *F25B 13/00* (2013.01); *F24F 11/64* (2018.01); *F24F 11/65* (2018.01); *F24F 2110/10* (2018.01); *F24F 2110/12* (2018.01)

(58) Field of Classification Search

CPC ..... F24F 11/67; F24F 11/65; F24F 2110/10; F24F 2110/12; F24F 11/64

See application file for complete search history.

(56) References Cited

U.S. PATENT DOCUMENTS 4,289,272 A * 9/1981 Murase ..... G05D 23/20 236/91 D
11,079,131 B2 * 8/2021 Konno ..... F24F 11/61

FOREIGN PATENT DOCUMENTS

JP 2014-020687 A 2/2014

* cited by examiner

*Primary Examiner* — Lionel Nouketcha
(74) *Attorney, Agent, or Firm* — Fujitsu Patent Center

(57) ABSTRACT

A control method includes: executing a generation process for generating criterion information based on an outdoor temperature, a room temperature of a space, and history information regarding an operation of an air-conditioning apparatus, the criterion information being information used for switching an operation mode of the air-conditioning apparatus between a first operation mode and a second operation mode, the first operation mode being configured to take an influence of the outdoor temperature into consideration, the second operation mode being different from the first operation mode, an air-conditioning load in the second operation mode being larger than an air-conditioning load in the first operation mode; and executing a control process for performing control of switching the operation mode of the air-conditioning apparatus to the first operation mode or the second operation mode based on the outdoor temperature, the room temperature of the space, and the criterion information.

15 Claims, 12 Drawing Sheets

FIG. 7

| SETTING ITEMS | SET VALUE |
|---|---|
| SET TEMPERATURE | 27°C |
| THERMO-OFF TEMPERATURE | 25°C |
| THERMO-ON TEMPERATURE | 28°C |
| OPERATION CAPACITY | 50% |

CONTROL METHOD, CONTROL APPARATUS, AND NON-TRANSITORY COMPUTER-READABLE STORAGE MEDIUM FOR STORING PROGRAM

CROSS-REFERENCE TO RELATED APPLICATION

This application is based upon and claims the benefit of priority of the prior Japanese Patent Application No. 2018-199520, filed on Oct. 23, 2018, the entire contents of which are incorporated herein by reference.

FIELD

The embodiments discussed herein are related to a control method, a control apparatus, and a non-transitory computer-readable storage medium storing a program.

BACKGROUND

A controllable range of an air-conditioning capacity of an air-conditioning apparatus for cooling and heating a room is limited. Thus, when an air-conditioning load of a space subjected to air-conditioning is small, control is performed by using air-conditioning control and on/off control of the air-conditioning apparatus in combinations. For example, there is known a technique for shifting a target temperature setting to reduce the number of times the air-conditioning apparatus is turned on and off when an air-conditioning load of a target space is less than the minimum air-conditioning capacity of the air-conditioning apparatus.

Examples of the related art include Japanese Laid-open Patent Publication No. 2014-20687.

SUMMARY

According to an aspect of the embodiments, a control method performed by a computer includes: executing a generation process that includes generating criterion information based on an outdoor temperature, a room temperature of a space subjected to air-conditioning, and history information regarding an operation of the air-conditioning apparatus, the criterion information being information used for switching an operation mode of the air-conditioning apparatus between a first operation mode and a second operation mode, the first operation mode being configured to take an influence of the outdoor temperature into consideration, the second operation mode being configured not to take the influence of the outdoor temperature into consideration, an air-conditioning load of an operation in the second operation mode being larger than an air-conditioning load of an operation in the first operation mode; and executing a control process when the air-conditioning apparatus performs air-conditioning in the space, the control process including performing control for switching the operation mode of the air-conditioning apparatus to the first operation mode or the second operation mode based on the outdoor temperature, the room temperature of the space, and the criterion information.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 7 is a diagram for describing setting items in a second embodiment;

DESCRIPTION OF EMBODIMENTS

Since an air-conditioning load of a target space is inferred from heat-generating devices, an outdoor temperature, and so on in the technique described above, the accuracy of the inference is not good. As a result, air-conditioning control of an air-conditioning apparatus is excessively performed in some cases and is not performed appropriately.

For example, a room temperature does not decrease soon in an evening period compared with a room temperature in a morning period because of an influence of solar radiation in an afternoon period. Thus, in the case where control is performed by using air-conditioning control based on the air-conditioning load and on/off control of the air-conditioning apparatus in combination around the minimum air-conditioning load, an actual air-conditioning load required in control is greater than an air-conditioning load to be operated. Consequently, a situation may occur where a period taken for the room temperature to reach a target temperature increases or the like.

In one aspect, it is an object to provide a control program, a control method, and a control apparatus that enable air-conditioning control based on an air-conditioning load of a target space to be performed appropriately.

Embodiments of a control program, a control method, and a control apparatus disclosed herein will be described in detail below with reference to the drawings. Note that these embodiments do not limit the present disclosure. Each of the embodiments may be appropriately combined with another embodiment within a scope without contradiction.

First Embodiment

[Example of Overall Configuration]

Figure 1:
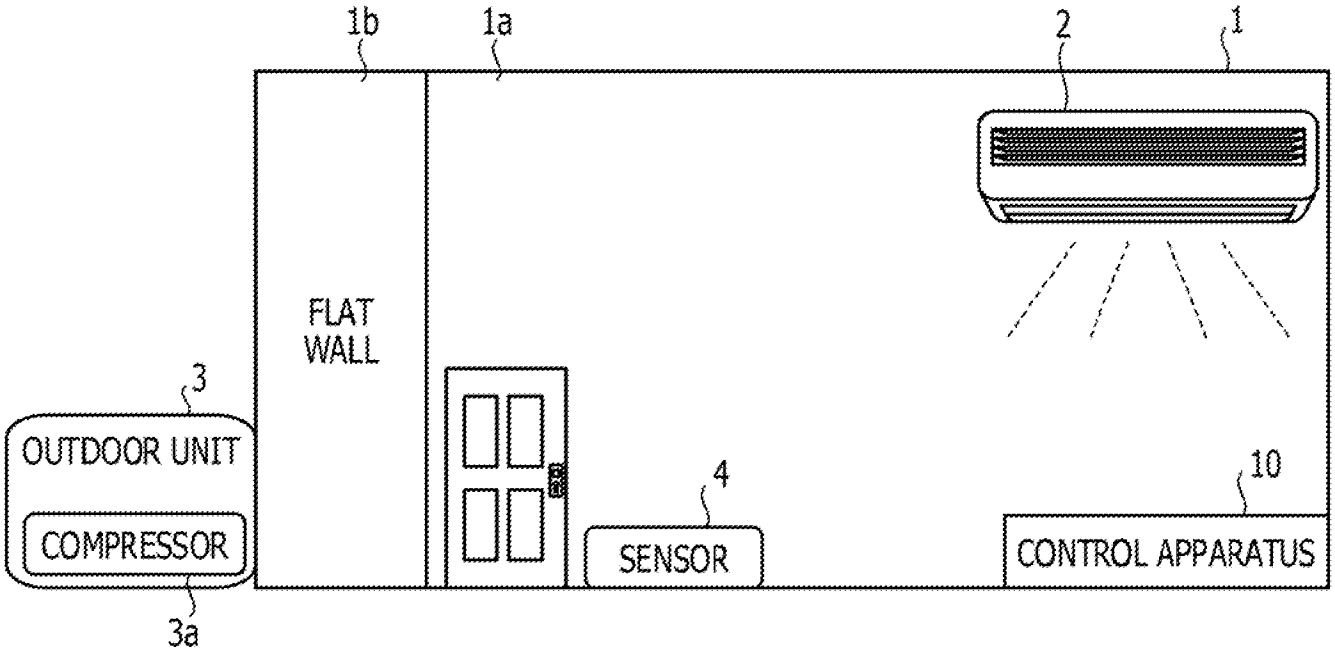
FIG. 1 is a diagram for describing an example of an overall configuration of a system according to a first embodiment.

FIG. 1 is a diagram for describing an example of an overall configuration of a system according to a first embodiment. As illustrated in FIG. 1, this system is a system including a control apparatus 10 and devices installed in a room 1 that is an example of a space subjected to air-conditioning control. The control apparatus 10 may be installed inside the room 1 or may be installed outside the room 1. A cloud system or the like may be used as the control apparatus 10, and the control apparatus 10 may be coupled via a network N to each of the devices installed in the room 1 subjected to air-conditioning control so as to be able to communicate with each other, Various wired or wireless communication networks such as the Internet may be adopted as the network N.

The room 1 includes a flat wall 1*b*, an air-conditioning apparatus 2, an outdoor unit 3, and a sensor 4. The flat wall 1*b* is an example of an outer wall for isolating an indoor space 1*a* from the outside. The air-conditioning apparatus 2 is installed in the indoor space 1*a*. The outdoor unit 3 is installed outside the room 1. The sensor 4 is installed in the indoor space 1*a*. The flat wall 1*b* is affected by an outdoor temperature and stores heat. The air-conditioning apparatus 2 is an air conditioner or the like for performing cooling or heating in the room 1. The air-conditioning apparatus 2 performs air-conditioning control in accordance with an instruction from the control apparatus 10. The outdoor unit 3 is an outdoor unit of the air-conditioning apparatus 2. The outdoor unit 3 includes a sensor that measures the outdoor temperature and a compressor 3*a*. The outdoor unit 3 collects an outdoor temperature history. The compressor 3*a* compresses refrigerant to make the refrigerant to high-temperature high-pressure refrigerant. The compressor 3*a* is driven by an inverter. An operation capacity of the compressor 3*a* is controlled in accordance with an air-conditioning state. The sensor 4 is a person sensor that detects whether a user is in the indoor space 1*a*. The sensor 4 collects a result indicating whether the user is detected, detection time, and so on.

The control apparatus 10 is an example of a control apparatus that manages the individual devices installed in the room 1 and performs air-conditioning control on the air-conditioning apparatus 2. The control apparatus 10 acquires the outdoor temperature history from the outdoor unit 3. The control apparatus 10 acquires information about the presence of the user in the room 1 (hereinafter, referred to as user presence information) including time at which the user started to be in the room 1 (hereinafter, referred to as presence start time) and time at which the user exited from the room 1 (hereinafter, referred to as exit time) from the sensor 4. The control apparatus 10 acquires history information or the like of the air-conditioning control performed in the indoor space 1*a* from the air-conditioning apparatus 2.

Common air-conditioning control will be described. In this embodiment, cooling will be described as an example. In the common air-conditioning control, operation control is performed such that an indoor temperature reaches a target temperature by specified time specified in advance. However, a change in the temperature in the indoor space 1*a* greatly varies depending on a heat storage state of the flat wall 1*b* of the target room 1 at the time when the operation is started.

Figure 2:
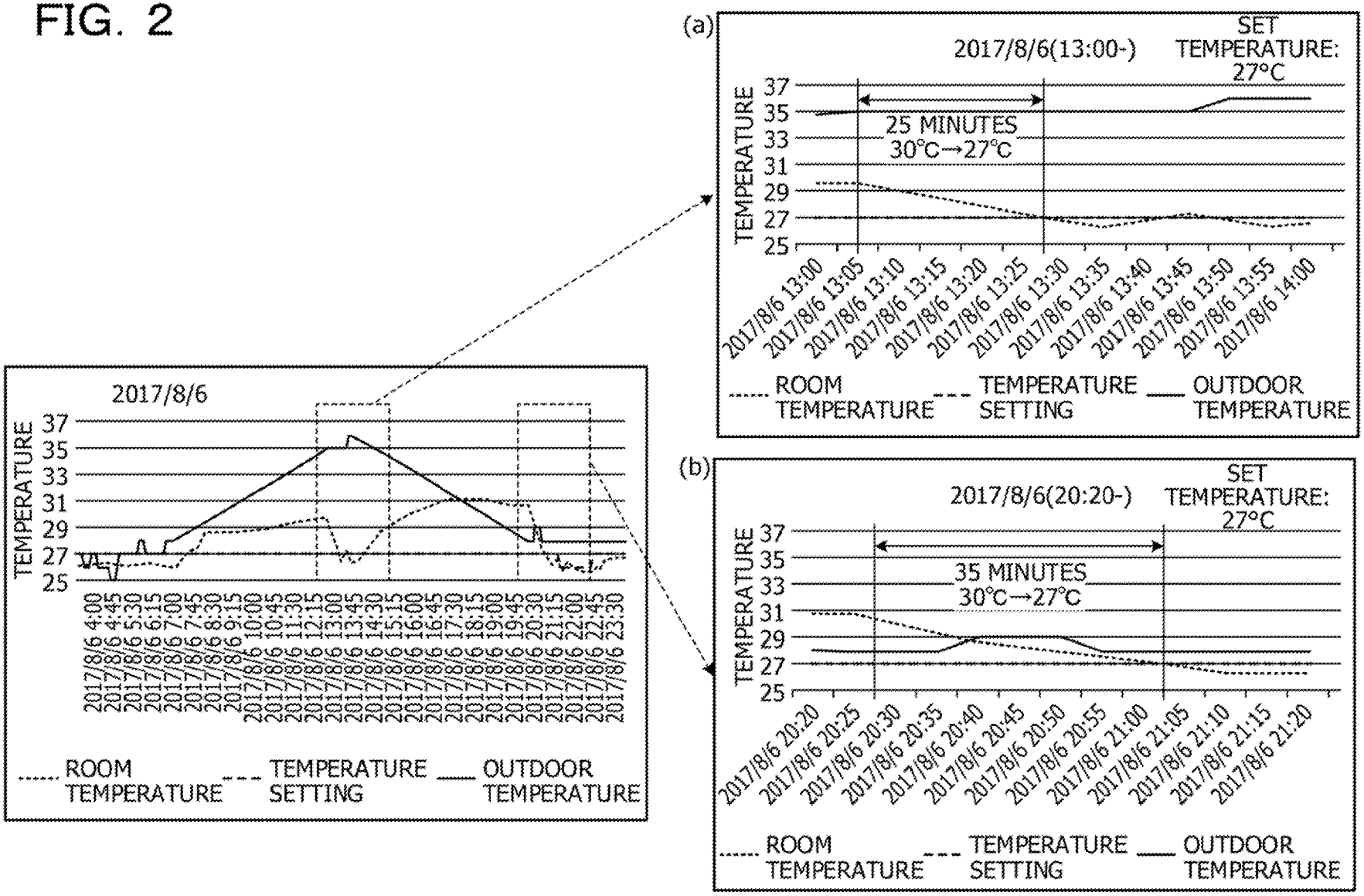
FIG. 2 is a diagram for describing an influence of heat storage.

FIG. 2 is a diagram for describing an influence of heat storage. FIG. 2 illustrates histories of a room temperature of a certain indoor space, an outdoor temperature, and a temperature setting. As illustrated in FIG. 2, since heat accumulated in an outer wall (corresponding to the flat wall 1*b* in FIG. 1) is dissipated during nighttime of the previous day, the outer wall is capable of storing heat in the morning. Thus, an increase in the room temperature is small although the outdoor temperature increases. Therefore, when the specified time is set to time in or around the morning, cooling is performed to the target temperature in a state where an increase in the room temperature due to an increase in the outdoor temperature is small. Thus, a period taken for cooling becomes shorter than expected. Consequently, the room temperature may decrease too low before the user is in the room as illustrated in (a) of FIG. 2.

Since the heat stored in the outer wall in the daytime is dissipated to the indoor space in the afternoon, the room temperature increases although the outdoor temperature decreases. Therefore, when the specified time is set to time at or after the evening time, cooling to the target temperature is performed in a state where there is an increase in the room temperature due to heat dissipation from the outer wall as illustrated in (b) of FIG. 2. Thus, a period taken for cooling becomes longer than expected as compared with (a) of FIG. 2. Consequently, the room temperature sometimes does not decrease sufficiently by the time when the user is in the room.

As described above, when control of the air-conditioning operation is performed based only on the indoor temperature, the outdoor temperature, and the target temperature, a situation may occur where the room temperature reaches the target temperature before the specified time or the room temperature does not reach the target temperature by the specified time. Thus, the discomfort of the user is rather increased or an unnecessary electric bill is caused.

Accordingly, the control apparatus 10 according to the first embodiment generates criterion information, based on the outdoor temperature, the room temperature of the room 1, and the history information about the operation of the air-conditioning apparatus 2. The criterion information is used for switching an operation mode between a first operation mode in which an influence of the outdoor temperature is taken into consideration and a second operation mode in which the influence of the outdoor temperature is not taken into consideration and the operation load is greater than that of the first operation mode. The control apparatus 10 performs control for switching an operation mode of the air-conditioning apparatus 2, based on the outdoor temperature, the room temperature of the room 1, and the criterion information when the air-conditioning apparatus 2 performs air-conditioning in the room 1.

For example, the control apparatus 10 generates a determination rule based on a relationship with the outdoor temperature and whether there is a heat inflow from the outside, as a criterion for determining the state of the space subjected to air-conditioning, and performs air-conditioning control with an air-conditioning load according to the determination result. In this way, the control apparatus 10 may perform appropriate control such as decreasing a period of an uncomfortable temperature.

[Functional Configuration]

Figure 3:
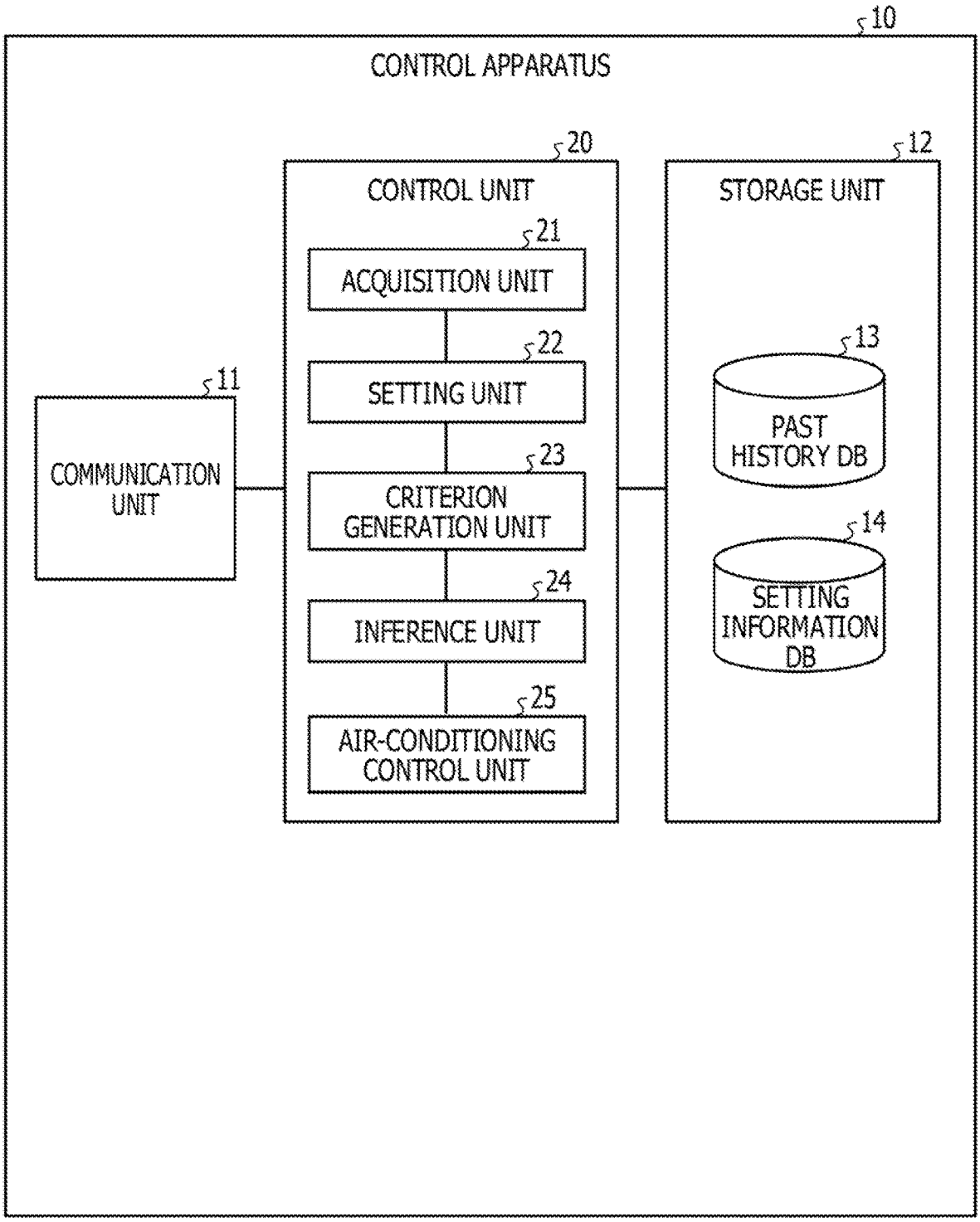
FIG. 3 is a functional block diagram illustrating a functional configuration of a control apparatus according to the first embodiment.

FIG. 3 is a functional block diagram illustrating a functional configuration of the control apparatus 10 according to the first embodiment. As illustrated in FIG. 3, the control apparatus 10 includes a communication unit 11, a storage unit 12, and a control unit 20. The communication unit 11 is a processing unit that controls communication with another apparatus. The communication unit 11 is, for example, a communication interface or the like. For example, the communication unit 11 performs transmission and reception of data to and from an administrator terminal and performs transmission and reception of data to and from the respective devices installed in the room 1.

The storage unit 12 is an example of a storage device that stores data and a program. The storage unit 12 is, for example, a memory, a hard disk, or the like. The storage unit 12 stores a past history database (DB) 1.3 and a setting information DB 14.

The past history DB 13 is a database for storing history information regarding air-conditioning control. For example, the past history DB 13 stores various kinds of history information such as details of air-conditioning control performed by the air-conditioning apparatus 2, the room temperature measured by the air-conditioning apparatus 2, the outdoor temperature measured by the outdoor unit 3, an operation capacity of the compressor 3*a*, and the user presence information of the user detected by the sensor 4. The kinds of information are each stored in the past history DB 13 in association with a date and time. Thus, the kinds of history information of the respective devices may be associated with each other.

The setting information DB 14 is a database for storing the target temperature and the specified time. For example, the target temperature may be arbitrarily set by the user or the like. The specified time is information specifying the time at which the room temperature reaches the target temperature. The specified time may be arbitrarily set by the user. Alternatively, the earliest presence start time, an average time of the presence start times, or the like may be set as the specified time from the past history.

The control unit 20 is a processing unit that manages the entire control apparatus 10 and is, for example, a processor or the like. The control unit 20 includes an acquisition unit 21, a setting unit 22, a criterion generation unit 23, an inference unit 24, and an air-conditioning control unit 25. The acquisition unit 21, the setting unit 22, the criterion generation unit 23, the inference unit 24, and the air-conditioning control unit 25 are examples of electronic circuits included in the processor or examples of processes executed by the processor.

The acquisition unit 21 is a processing unit that acquires various kinds of data from the individual devices in the room 1. For example, the acquisition unit 21 acquires the details of the air-conditioning control and the room temperature from the air-conditioning apparatus 2, acquires the outdoor temperature from the outdoor unit 3, acquires the operation capacity from the compressor 3*a*, and acquires the user presence information (whether or not the user is in the room 1 and the presence start time) from the sensor 4. The acquisition unit 21 stores the acquired information in the past history DB 13. The acquisition unit 21 may acquire the information periodically or may acquire the information when there is a change in the information to be acquired. Each of the devices may spontaneously transmit the corresponding information.

The setting unit 22 is a processing unit that sets the target temperature and the specified time. For example, the setting unit 22 sets a temperature accepted from the user as the target temperature and stores the target temperature in the setting information DB 14. The setting unit 22 may set the earliest presence start time as the specified time with reference to the past history DB 13 and store the specified time in the setting information DB 14. Alternatively, the setting unit 22 may calculate an average time of the presence start times of the respective days, set the average time as the specified time, and store the specified time in the setting information DB 14.

The criterion generation unit 23 is a processing unit that generates criterion information used for switching the operation mode. For example, the criterion generation unit 23 generates a determination criterion, based on a relationship between the outdoor temperature and the room temperature, whether there is a heat inflow from the outside to the indoor space 1*a*, and so on.

For example, the criterion generation unit 23 refers to a history of the air-conditioning control in the past (such as changes in the operation capacity of the compressor 3*a* and in the room temperature), and identifies a relationship between an influence of heat dissipation from the flat wall 1*b* (outer wall) to the indoor space 1*a* and air-conditioning control performed by the air-conditioning apparatus 2. For example, in consideration of the above-described influence of heat dissipation from the outer wall to the indoor space 1*a*, the criterion generation unit 23 may predict that a period taken for decreasing the room temperature of the room to be cooled to a target temperature is shorter in a state where the room temperature is not affected by the rising outdoor temperature than that in a state where the room temperature is affected by the outdoor temperature. In other words, the criterion generation unit 23 may predict that cooling is successfully performed with a small operation capacity of the compressor 3*a* in a period in which the outer wall is capable of storing heat. That is, the criterion generation unit 23 may predict that the air-conditioning load is small in the period in which the outer wall is capable of storing heat.

On the other hand, in the state where the room temperature is affected by the rising outdoor temperature, the criterion generation unit 23 may predict that the cooling period changes depending on the relationship between the room temperature and the outdoor temperature. In other words, the criterion generation unit 23 may predict that the operation capacity of the compressor 3*a* is to be increased when the current room temperature (room temperature at the time when the cooling period is calculated) is higher than the outdoor temperature in a time period in which the outer wall is no longer capable of storing heat and heat dissipation from the outer wall to the indoor space 1*a* occurs. That is, the criterion generation unit 23 may predict that the air-conditioning load is large in the period in which the outer wall is no longer capable of storing heat.

Based on these predictions, the criterion generation unit 23 generates a determination criterion such that a first operation mode is selected when a change in the room temperature is affected by the outdoor temperature and a second operation mode is selected when the change in the room temperature is not affected by the outdoor temperature. The criterion generation unit 23 may also generate a determination criterion with which the operation mode is further switched depending on whether the room temperature is lower than or higher than the outdoor temperature when the second operation mode is selected. The determination criterion may be generated by an administrator or the like in advance.

Figure 4:
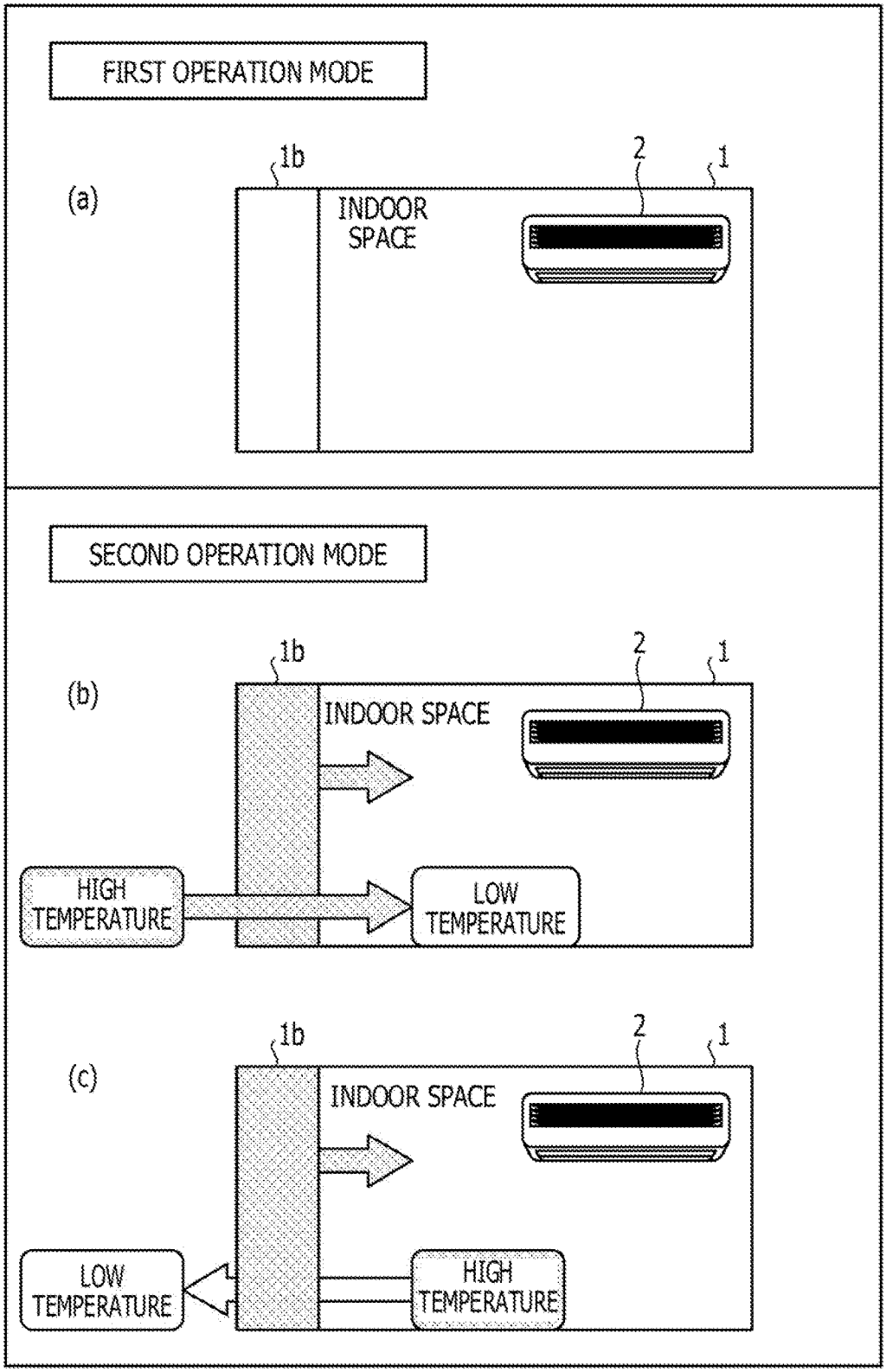
FIG. 4 is a diagram illustrating a relationship between operation modes and a load factor.

A relationship between each operation mode and the air-conditioning load will be described, FIG. 4 is a diagram illustrating a relationship between operation modes and a load factor. The state of the first operation mode is illustrated in (a) of FIG. 4, and the state of the second operation mode is illustrated in (b) and (c) of FIG. 4.

In a state where the flat wall 1*b* is capable of storing heat as illustrated in (a) in FIG. 4, the influence of the outdoor temperature on the room temperature is small, Thus, a small air-conditioning load is settable. In a state where a large amount of heat dissipation from the flat wall 1*b* to the indoor space 1*a* occurs and the room temperature is lower than the outdoor temperature as illustrated in (b) of FIG. 4, the influence of the outdoor temperature on the room temperature is very large. Thus, a very high air-conditioning load is settable. In a state where heat dissipation from the flat wall 1*b* to the indoor space 1*a* occurs and the room temperature is higher than the outdoor temperature as illustrated in (c) of FIG. 4, there is not a small influence of the outdoor temperature on the room temperature. Thus, a high air-conditioning load or the like is settable. In (c) of FIG. 4, a heat outflow from the indoor space 1*a* to the outside is not taken into consideration.

The inference unit 24 is a processing unit that infers an air-conditioning load of the indoor space 1*a* that is a space subjected to air-conditioning controls. For example, the inference unit 24 infers the air-conditioning load by using the criterion information generated by the criterion generation unit 23 at a certain timing when air-conditioning control is started or is performed.

For example, the inference unit 24 infers that the air-conditioning load is "low" (for example, 20%) when the room temperature is not affected by the outdoor temperature. The inference unit 24 infers that the air-conditioning load is "high" (for example, 80%) when the room temperature is affected by the outdoor temperature and is lower than the outdoor temperature. The inference unit 24 infers that the air-conditioning load is "intermediate" (for example, 40%) when the room temperature is affected by the outdoor temperature and is higher than the outdoor temperature.

The criterion used for determining whether the change in the room temperature is affected by the outdoor temperature may be, for example, a criterion with which it may be determined that there is an influence of the outdoor temperature when the room temperature is higher than a threshold by comparing a median value (threshold) of room temperatures obtained in the morning of a plurality of days for which the room temperature is not affected by the outdoor temperature with the current room temperature (room temperature when the air-conditioning control is started). Besides the median value, an average value or the like may also be adopted.

The air-conditioning control unit 25 is a processing unit that performs air-conditioning control based on the air-conditioning load inferred by the inference unit 24. For example, when the air-conditioning load is inferred to be "low" by the inference unit 24, the air-conditioning control unit 25 performs air-conditioning control by setting the operation capacity of the compressor 3*a* to 20%. When the air-conditioning load is inferred to be "intermediate" by the inference unit 24, the air-conditioning control unit 25 performs air-conditioning control of cooling that is stronger than cooling performed in the case where the air-conditioning load is "low", by setting the operation capacity of the compressor 3*a* to 40%. When the air-conditioning load is inferred to be "high" by the inference unit 24, the air-conditioning control unit 25 performs air-conditioning control of cooling that is stronger than cooling performed in the case where the air-conditioning load is "intermediate", by setting the operation capacity of the compressor 3*a* to 80%.

The air-conditioning control unit 25 is capable of performing air-conditioning control to maintain the room temperature when the room temperature reaches the target temperature. The air-conditioning control unit 25 is also capable of performing air-conditioning control as pre-cooling control by the specified time at which the user starts to be in the room and of performing air-conditioning control as cooling control that is performed when the user is in the room. In the case of the pre-cooling control, various known methods may be adopted as for which timing pre-cooling is to be started,

[Process Flow]

Figure 5:
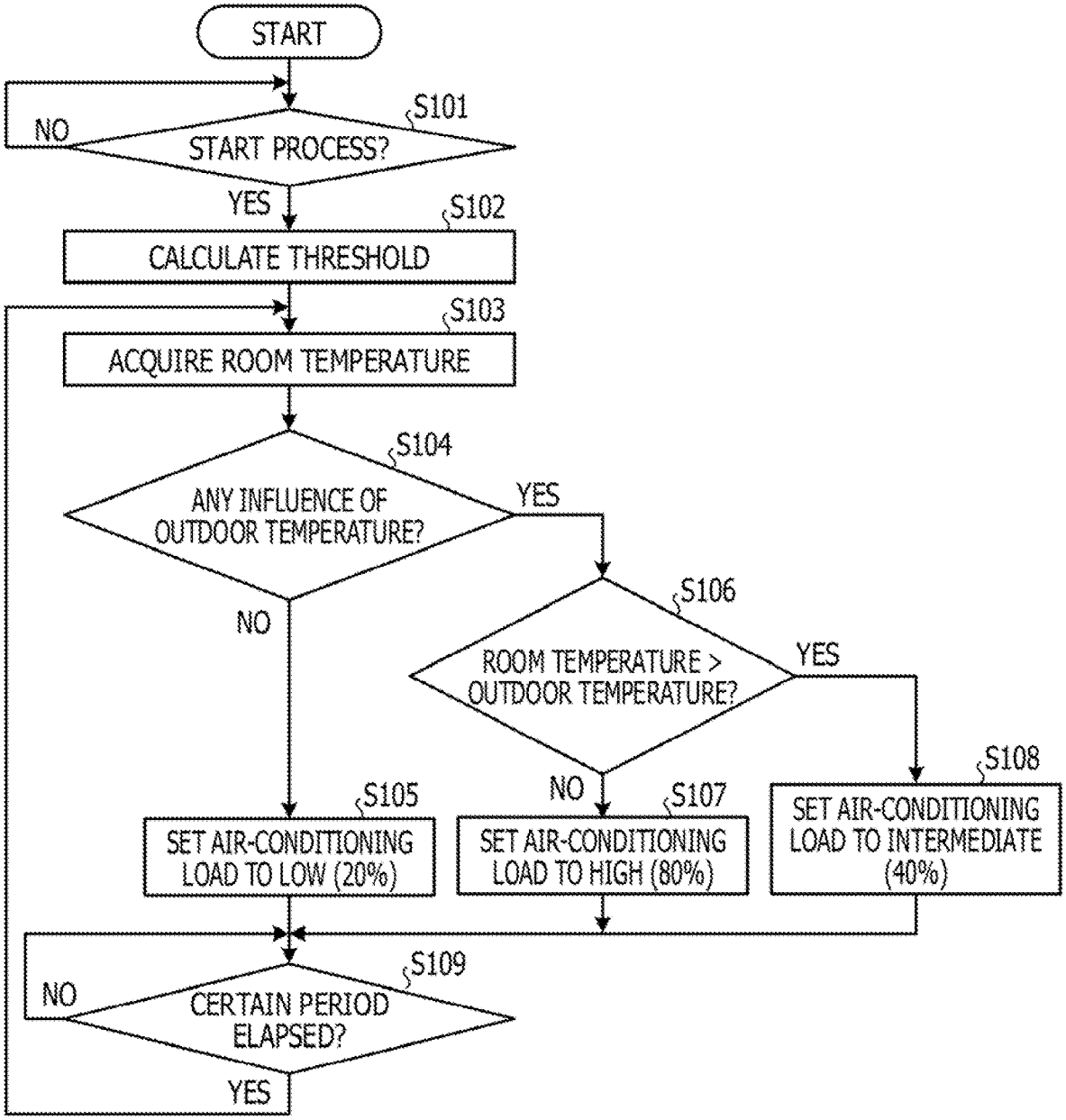
FIG. 5 is a flowchart illustrating a flow of a process.

FIG. 5 is a flowchart illustrating a flow of a process. It is assumed that the determination criterion has been generated by the criterion generation unit 23. The timing at which the determination criterion is generated may be preferably before S104 in FIG. 5, and generation of the determination criterion may be performed at a given timing.

As illustrated in FIG. 5, upon receiving an instruction to start a process (S101: Yes), the inference unit 24 calculates a threshold that is used when whether the room temperature is affected by the outdoor temperature is determined (S102). This threshold may be calculated in advance.

The acquisition unit 21 then acquires the room temperature, the outdoor temperature, and so on (S103). If the room temperature is lower than the threshold, that is, if the room temperature is not affected by the outdoor temperature (S104: No), the inference unit 24 sets the air-conditioning load to "low (20%)" (S105), As a result, the air-conditioning control unit 25 performs air-conditioning control by changing the compression capacity to a compression capacity corresponding to the air-conditioning load of "low".

If the room temperature is higher than the threshold, that is, the room temperature is affected by the outdoor temperature (S104; Yes), the inference unit 24 determines whether the room temperature is higher than the outdoor temperature (S106). If the room temperature is lower than the outdoor temperature (S106: No), the inference unit 24 sets the air-conditioning load to "high (80%)" (S107). As a result, the air-conditioning control unit 25 performs air-conditioning control by changing the compression capacity to a compression capacity corresponding to the air-conditioning load of "high".

If the room temperature is higher than the outdoor temperature (S106: Yes), the inference unit 24 sets the air-conditioning load to "intermediate (40%)" (S108). As a result, the air-conditioning control unit 25 performs air-conditioning control by changing the compression capacity to a compression capacity corresponding to the air-conditioning load of "intermediate". After a certain period elapses (S109: Yes) since one of S105, S107, and S108 is performed, S103 and subsequent steps are repeated.

Advantages

As described above, the control apparatus 10 may appropriately infer the state of the air-conditioning load of the indoor space subjected to air-conditioning control and may perform air-conditioning control according to the inferred air-conditioning load. As a result, the control apparatus 10 may suppress the occurrence of a state where the room temperature decreases too low by the specified time and a state where the room temperature does not decrease sufficiently by the specified time. Thus, the control apparatus 10 may reduce the discomfort of the user and save an electric bill by reducing a period of wasteful air-conditioning control.

Figure 6:
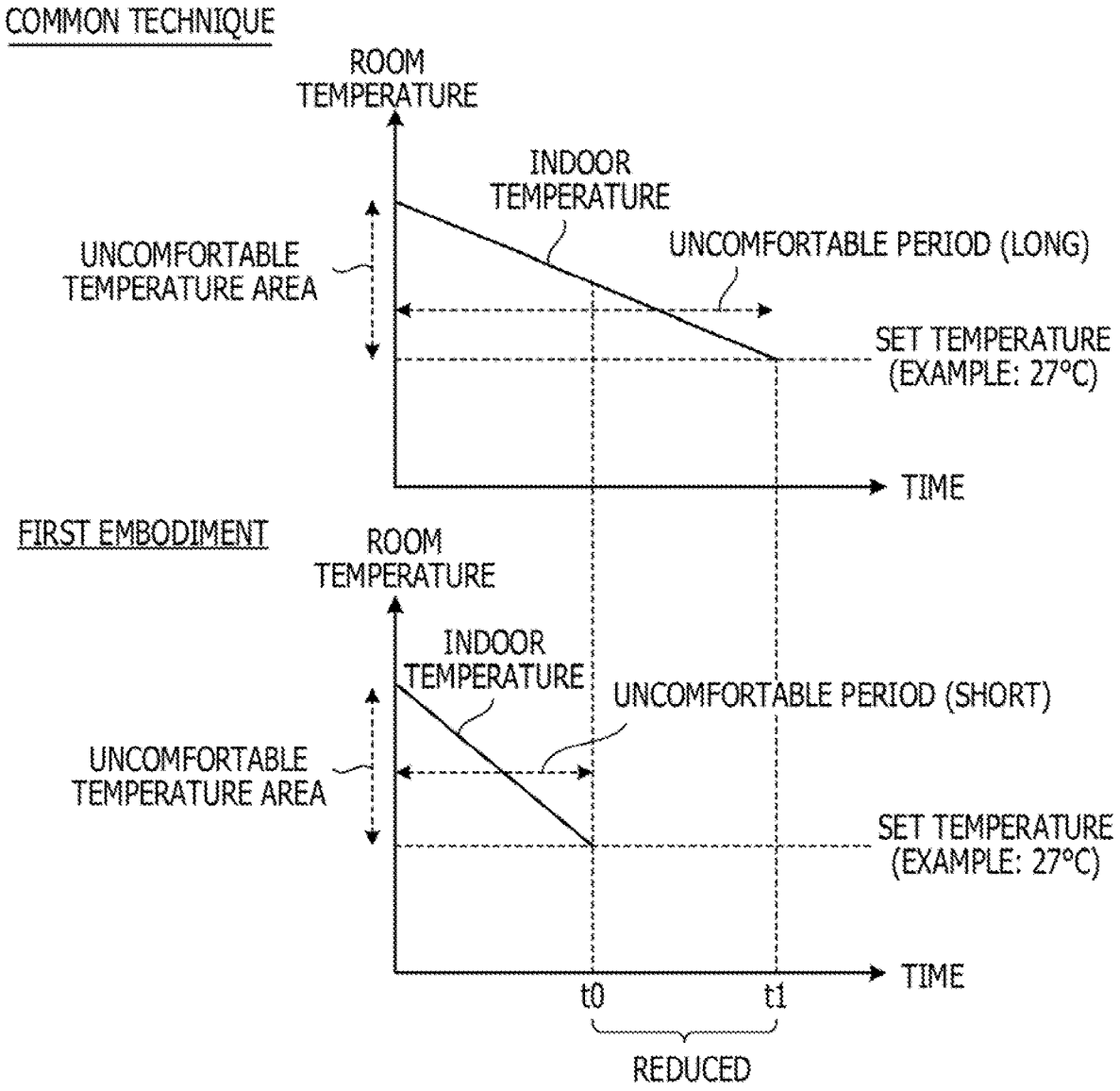
FIG. 6 is a diagram for describing advantages.

FIG. 6 is a diagram for describing the advantages. An example where cooling to a set temperature is performed in the nighttime will be described by using FIG. 6. In a common technique illustrated in FIG. 6, since heat stored in the flat wall 1*b* in the daytime is dissipated to the indoor space 1*a*, the room temperature does not decrease soon, Thus, a period of an uncomfortable temperature area increases. Consequently, an uncomfortable period of the user also increases.

In contrast, in the technique according to the first embodiment illustrated in FIG. 6, the air-conditioning load may be inferred in consideration of the fact that heat stored in the flat wall 1*b* in the daytime is dissipated to the indoor space 1*a* and air-conditioning control may be performed in accordance with the air-conditioning load. Thus, the room temperature may be appropriately decreased. Consequently, the period of the uncomfortable temperature area decreases and an uncomfortable period of the user also decreases. In the example illustrated in FIG. 6, time at which the room temperature reaches the set temperature is t1 with the common technique, whereas time at which the room temperature reaches the set temperature is t0 with the technique according to the first embodiment. Thus, the technique according to the first embodiment may reduce the cooling period by a period (t1−t0), compared with the common technique.

Second Embodiment

The control apparatus 10 described above may perform air-conditioning control for reducing the discomfort of the user in widely disclosed air-conditioning control that realizes improved power-saving by using thermo-on temperature and thermo-off temperature. Accordingly, in a second embodiment, a description will be given by using, as an example, air-conditioning control that realizes improved power-saving (hereinafter also referred to as common control).

Setting items that are set in the second embodiment will be described first. FIG. 7 is a diagram for describing the setting items in the second embodiment. As illustrated in FIG. 7, a set temperature, a thermo-off temperature, a thermo-on temperature, and an operation capacity are set in the second embodiment. The set temperature that is set in the second embodiment refers to a temperature set by a user and is "27° C." in the second embodiment.

As the thereto-off temperature, a temperature used for determining thermo-off is set. The thermo-off temperature is "25° C." in the second embodiment. Thermo-off refers to an operation for stopping the operation of the compressor 3*a* of the air-conditioning apparatus 2 when the indoor temperature greatly deviates from the set temperature and the operation of the air-conditioning apparatus 2 becomes excessive. As the thermo-on temperature, a temperature used for determining thermo-on is set. The thermo-on temperature is "28° C." in the second embodiment. Thermo-on refers to an operation for resuming the operation of the compressor 3*a* of the air-conditioning apparatus 2 after it is determined that the operation of the air-conditioning apparatus 2 is required in a state where air-conditioning control is stopped by thermo-off.

The operation capacity is an operation capacity of the compressor 3*a* that is dynamically changed in accordance with the air-conditioning load by using the technique described in the first embodiment. The operation capacity is, for example, "50%" or the like. The operation capacity is often fixed to the minimum capacity of "20%" in common operation control that realizes improved power-saving (common control).

Figure 8:
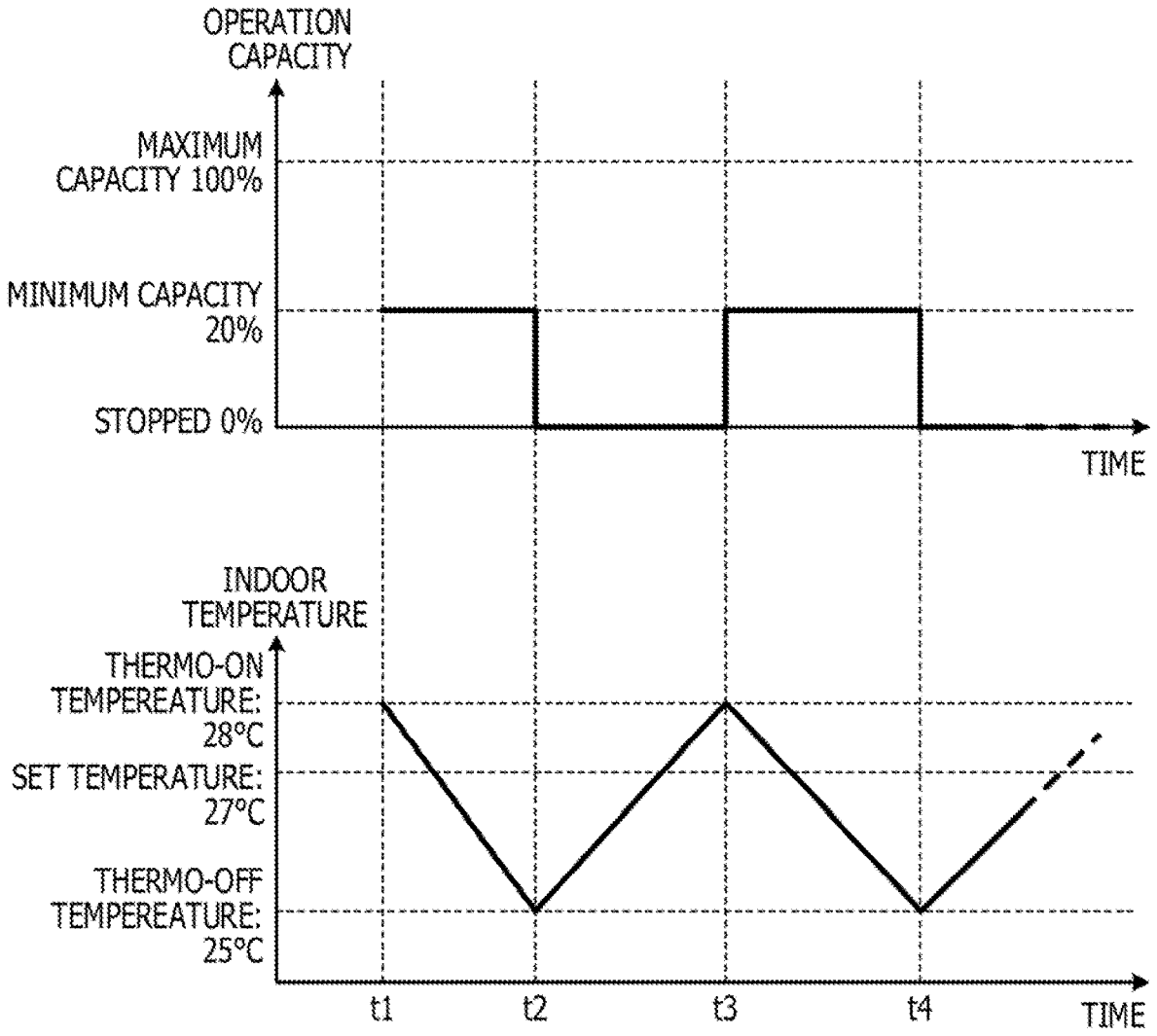
FIG. 8 is a diagram for describing common power-saving air-conditioning control.

The common control that is to be improved in the second embodiment will be described. In the common control, air-conditioning control is performed with the minimum capacity of 20% in consideration of power-saving. FIG. 8 is a diagram for describing the common power-saving air-conditioning control. An upper diagram of FIG. 8 illustrates a change in the operation capacity of the compressor 3*a* over time, and a lower diagram of FIG. 8 illustrates a change in the room temperature over time. As illustrated in FIG. 8, air-conditioning control is started at time t1 at which the indoor temperature is the thermo-on temperature of 28° C.

When the cooled indoor temperature falls below the set temperature (27° C.) and becomes lower than or equal to the thereto-off temperature (25° C.) at time t2, thermo-off activates and the air-conditioning control stops.

The indoor temperature increases because the air-conditioning control is stopped and exceeds the set temperature (27° C.) and becomes higher than or equal to the thereto-on temperature (28° C.) at time t3. At that time, thermo-on activates and the air-conditioning control is resumed with the minimum capacity.

When the indoor space is cooled and the indoor temperature falls below the set temperature (27° C.) and becomes lower than or equal to the thermo-off temperature (25° C.) at time t4, the thermo-off activates and the air-conditioning control stops.

As described above, the common control realizes both the improved power-saving and the reduction in the discomfort of the user by repeating the thermo-off and the thermo-on even in the air-conditioning operation with the minimum capacity. However, in the common control, the air-conditioning control is performed with the minimum capacity regardless of the state of the air-conditioning load of the indoor space 1*a*. Thus, the period taken for the room temperature to be the thermo-off temperature from the thermo-on temperature is not necessarily the same all the time as illustrated in FIG. 8. The air-conditioning control takes longer in a state where the air-conditioning load is high than in a state where the air-conditioning load is low. Thus, the discomfort of the user increases.

Accordingly, in the second embodiment, both power-saving and a reduction in the discomfort of the user are realized by performing air-conditioning control with an operation capacity according to the state of the air-conditioning load in power-saving control in which thermo-off and thermo-on are repeated.

Figure 9A:
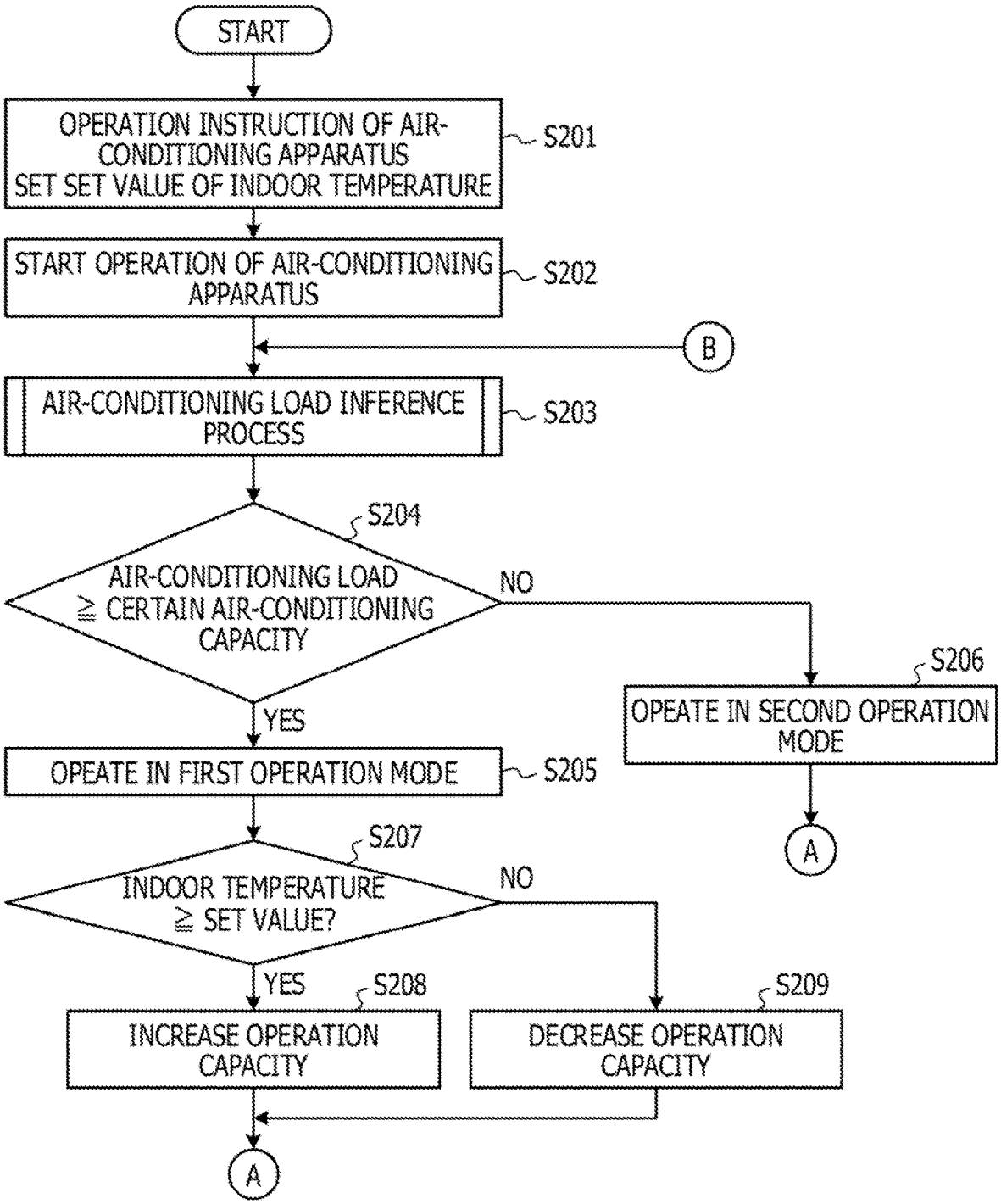
FIGS. 9A and 9B are flowcharts illustrating a flow of process according to the second embodiment.

FIGS. 9A and 96 are flowcharts illustrating a flow of a process according to the second embodiment. As illustrated in FIG. 9A, the setting unit 22 of the control apparatus 10 accepts an operation instruction of the air-conditioning apparatus 2 and sets a set value of the indoor temperature (target temperature) (S201). The air-conditioning control unit 25 then starts an operation of the air-conditioning apparatus 2 based on the operation instruction (S202).

The inference unit 24 then performs an air-conditioning load inference process to infer the current air-conditioning load of the indoor space 1*a* (S203). For example, the inference unit 24 infers the air-conditioning load by using the technique described in FIG. 5.

If the inferred air-conditioning load is higher than or equal to a certain air-conditioning capacity (S204: Yes), the air-conditioning control unit 25 performs air-conditioning control in a first operation mode (S205). For example, the air-conditioning control unit 25 performs air-conditioning control corresponding to a result obtained as a result of the inference unit 24 performing S105 described in FIG. 5. If the inferred air-conditioning load is lower than the certain air-conditioning capacity (S204: No), the air-conditioning control unit 25 performs air-conditioning control in a second operation mode (S206), For example, the air-conditioning control unit 25 performs air-conditioning control corresponding to a result obtained as a result of the inference unit 24 performing S106 to S108 described in FIG. 5.

While the control is being performed in the first operation mode, if the indoor temperature is higher than or equal to the set value (S207: Yes), the air-conditioning control unit 25 increases the operation capacity of the compressor 3*a* (S208), If the indoor temperature is lower than the set value (S207: No), the air-conditioning control unit 25 decreases the operation capacity of the compressor 3*a* (S209).

Figure 9B:
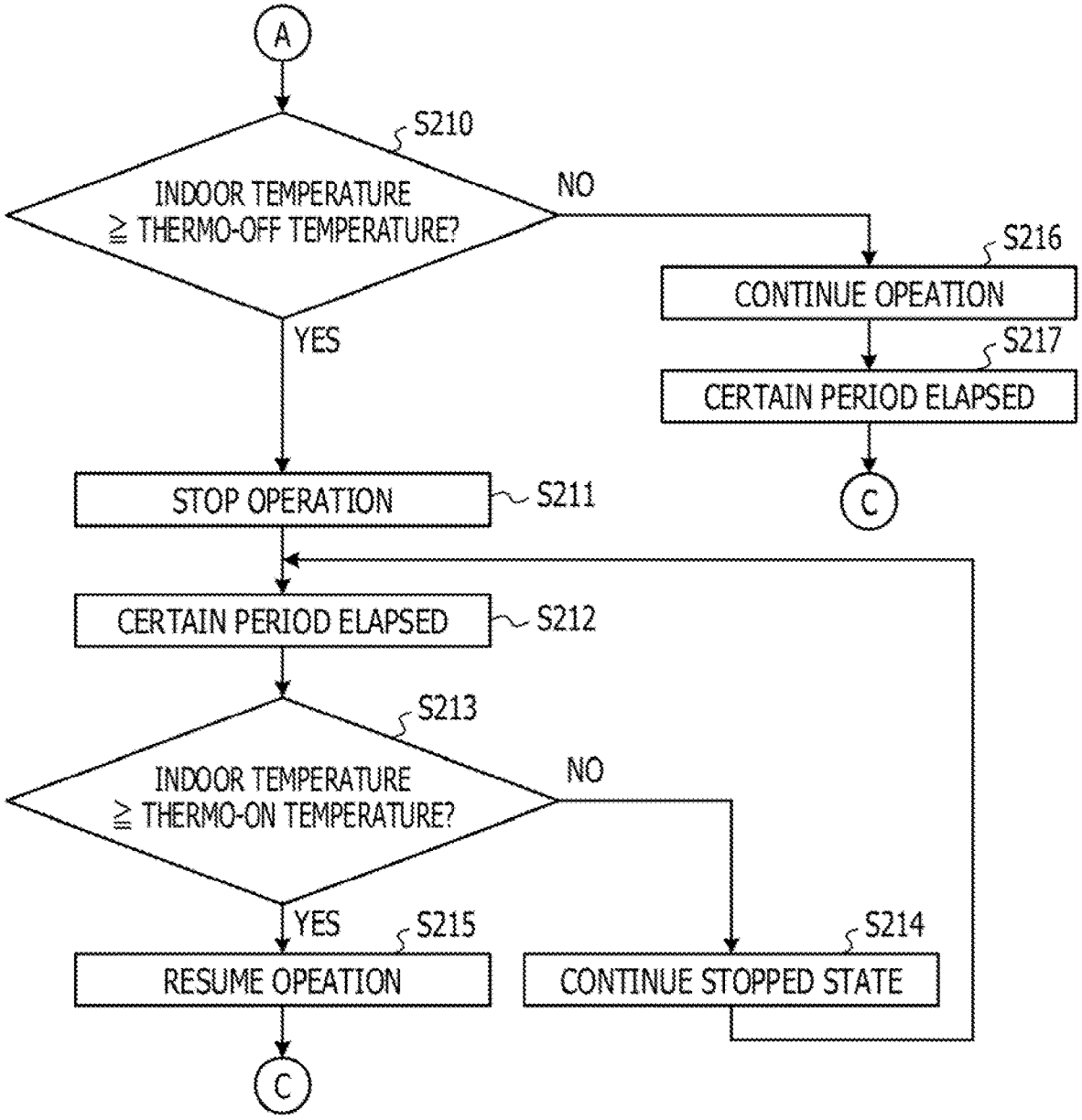

As illustrated in FIG. 9B, if the indoor temperature becomes lower than the thermo-off temperature (S210: Yes) while the control is being performed in the first operation mode or the second operation mode, the air-conditioning control unit 25 stops the operation of the compressor 3*a* and stops the air-conditioning control (S211).

After an elapse of a certain period since the operation of the compressor 3*a* is stopped (S212), the air-conditioning control unit 25 determines whether the indoor temperature is higher than or equal to the thereto-on temperature (S213). If the indoor temperature is lower than the thermo-on temperature (S213: No), the air-conditioning control unit 25 keeps the compressor 3*a* in the stopped state (S214) and repeats S212 and the subsequent steps.

If the indoor temperature becomes higher than or equal to the thermo-on temperature (S213: Yes), the air-conditioning control unit 25 resumes the operation of the compressor 3*a* and resumes the air-conditioning control (S215) and repeats S203 and the subsequent steps.

If the indoor temperature is higher than or equal to the thermo-off temperature in S210 while the control is being performed in the first operation mode or the second operation mode (S210: No), the air-conditioning control unit 25 continues the operation of the compressor 3*a* and continues the air-conditioning control (S216). In this case, S203 and the subsequent steps are repeated after an elapse of a certain period (S217).

As described above, the control apparatus 10 according to the second embodiment may perform air-conditioning control with an operation capacity according to the state of the air-conditioning load in power-saving control in which thereto-off and thereto-on are repeated. As a result, the room temperature is successfully decreased to the temperature set by the user sooner than the common control. Thus, a reduction in the discomfort of the user may be realized.

Third Embodiment

While the embodiments of the present disclosure have been described above, the present disclosure may be carried out in various different embodiments other than the embodiments described above.

[Target Space]

In the embodiments described above, a room of a company or the like has been described as an example; however, the target space is not limited thereto. For example, various spaces such as the inside of a train, a car, or the like, a machine room, and the inside of a plane may be set as the target space.

[Control Apparatus]

In the first embodiment, the example has been described in which the control apparatus 10 and the air-conditioning apparatus 2 are realized as different apparatuses; however, the configuration is not limited thereto. For example, even if the air-conditioning apparatus 2 is an apparatus including the control apparatus 10, the air-conditioning apparatus 2 may perform processing in substantially the same manner. The control apparatus 10 may include the above-described various sensors such as the sensor 4. The specific method of the air-conditioning control is an example. Various known methods for changing the operation power of the air-conditioning apparatus 2 or the like as well as controlling the operation capacity of the compressor 3*a* may be adopted.

[Cloud]

Figure 10:
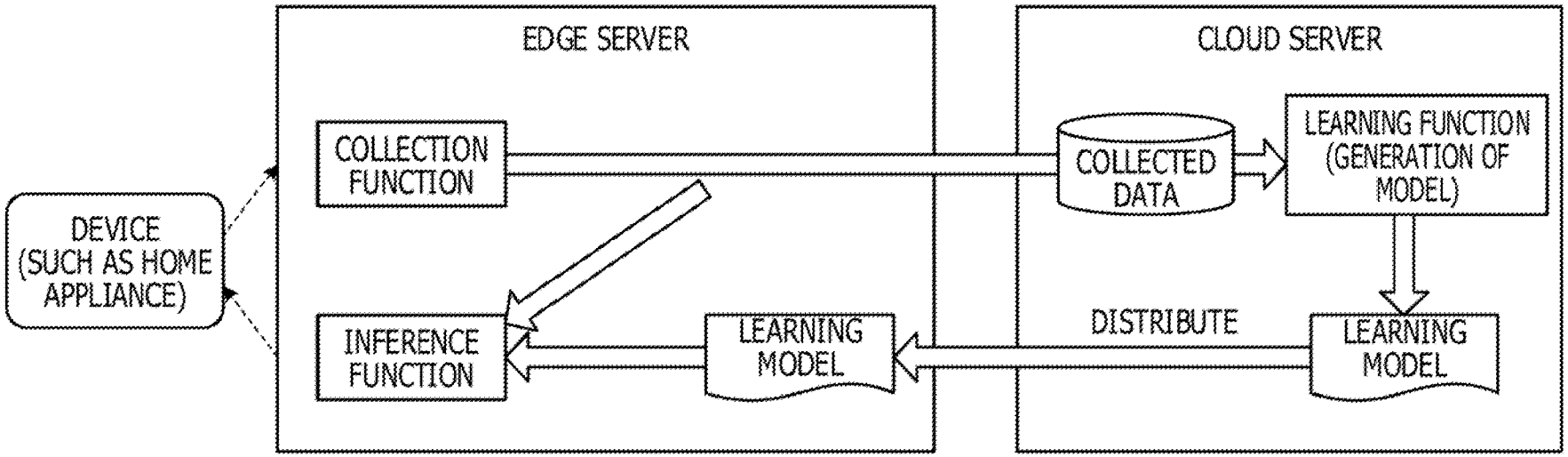
FIG. 10 is a diagram for describing cooperation with the cloud.

The air-conditioning control described above may be realized by using a cloud system. FIG. 10 is a diagram for describing cooperation with the cloud. As illustrated in FIG. 10, an edge server installed in a space or the like subjected to air-conditioning control and a cloud server may be configured to cooperate with each other. The edge server collects various kinds of information from devices such as the air-conditioning apparatus 2 and the outdoor unit 3 and transmits the various kinds of information to the cloud server. The cloud server generates a learning model for predicting a room temperature by using the various kinds of collected information acquired from the edge server and distributes the learning model to the edge server. The edge server then predicts a change in the room temperature or the like by using the learning model acquired from the cloud server and performs air-conditioning controls.

In this way, distributed processing may be realized, and a reduction in the operation rate or the data area of the processor of the cloud server may be realized. The control apparatus 10 described above may cause a microcomputer or the like included in a remote control of the air-conditioning apparatus 2 to download data of an operation plan and cause the remote control to perform automatic control according to the operation plan,

[Operation Modes]

In the first embodiment, the example has been described in which three states of the air-conditioning load are determined and one of the three air-conditioning control modes is performed; however, the configuration is not limited thereto. For example, two states of the air-conditioning load may be determined depending on whether the current state is a state where the room temperature is affected by the outdoor temperature, and air-conditioning control according to one of the two states of the air-conditioning load may be performed, That is, the control may be performed in a corresponding operation mode among the two operation modes.

[Application to Heating]

In the first embodiment, cooling (pre-cooling) has been described as an example; however, heating (pre-heating) may also be performed in the similar manner. In the case of heating, a situation opposite to that of cooling occurs because of heat dissipation from the outer wall having accumulated the heat to the indoor space. Thus, the air-conditioning load is also opposite. For example, in a time period in which there is heat dissipation from the outer wall to the indoor space, heating progresses by the heat dissipation in addition to heating by the air-conditioning apparatus. Thus, the air-conditioning load is small and a pre-heating period decreases unlike the pre-cooling period. In a time period in which heat dissipation from the outer wall to the indoor space is small and the outdoor temperature is lower than the room temperature, the air-conditioning load is high and the influence of heating is small. Consequently, the pre-heating period increases. As described above, the operation mode may be selected for heating from substantially the same viewpoint as that of the first embodiment,

[System]

The processing procedures, the control procedures, the specific names, and the information including the various kinds of data and parameters cited in the specification and drawings described above may be arbitrarily changed unless otherwise specified. The specific examples, distributions, numerical values, and so on described in the embodiments are merely examples and may be arbitrarily changed.

In addition, the elements of each of the apparatuses and devices illustrated in the drawings are functionally conceptual and do not necessarily have to be physically configured as illustrated. For example, the specific configuration regarding the dispersion and integration of the apparatuses and devices is not limited to the illustrated one. For example, all or some of the apparatuses and devices may be configured to be distributed or integrated functionally or physically in given units depending on various loads and usage conditions. In addition, all or given some of processing functions performed by the apparatuses and devices may be implemented by a CPU and a program to be analyzed and executed by the CPU, or may be implemented as hardware by wired logic.

[Hardware]

Figure 11:
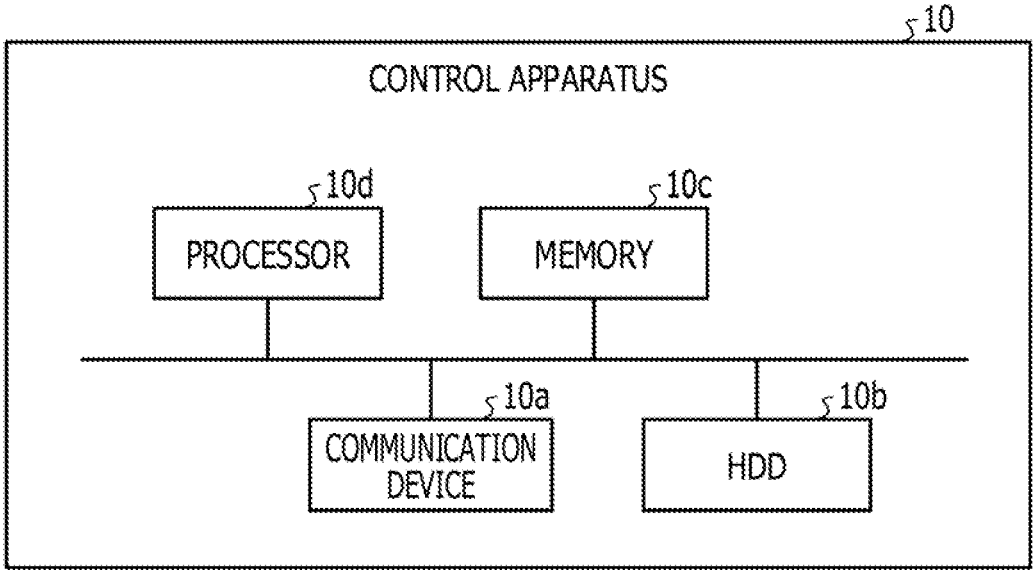
FIG. 11 is a diagram for describing an example of a hardware configuration.

FIG. 11 is a diagram for describing an example of a hardware configuration. As illustrated in FIG. 11, the control apparatus 10 includes a communication device 10*a*, a hard disk drive (HDD) 10*b*, a memory 10*c*, and a processor 10*d*. The communication device 10*a*, the HDD 10*b*, the memory 10*c*, and the processor 10*d* illustrated in FIG. 11 are coupled to one another by a bus or the like.

The communication device 10*a* is a network interface card or the like and performs communication with another server. The HDD 10*b* stores a program for causing the functional units illustrated in FIG. 3 to operate and stores the DBs illustrated in FIG. 3.

The processor 10*d* reads, from the HDD 10*b* or the like, a program for causing the substantially the same processes as those of the processing units illustrated in FIG. 3 to be performed and loads the program to the memory 10*c* to run a process of performing the functions described with reference to FIG. 3 and so on. For example, this process performs a function that is substantially the same as that of each of the processing units included in the control apparatus 10. For example, the processor 10*d* reads, from the HDD 10*b* or the like, a program having functions that are substantially the same as those of the acquisition unit 21, the setting unit 22, the criterion generation unit 23, the inference unit 24, the air-conditioning control unit 25, and so on. The processor 10*d* runs a process of performing processing that is substantially the same as the processing of the acquisition unit 21, the setting unit 22, the criterion generation unit 23, the inference unit 24, the air-conditioning control unit 25, and so on.

As described above, the control apparatus 10 operates as an information processing apparatus that carries out a control method by reading and executing a program. The control apparatus 10 may implement functions that are substantially the same as those of the embodiments described above by reading the program from a recording medium with a medium reading apparatus and by executing the read program. The program described in other embodiments is not limited to a program that is executed by the control apparatus 10. For example, the present disclosure may also be applied to cases where another computer or a server executes the program and where another computer and a server execute the program in cooperation with each other.

The program may be distributed via a network such as the Internet. The program may be recorded on a computer-readable recording medium such as a hard disk, a flexible disk (FD), a compact disc read-only memory (CD-ROM), a magneto-optical disk (MO), a digital versatile disc (DVD), or the like, and may be executed after being read from the recording medium by a computer.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A control method performed by a computer, comprising:

executing a generation process that includes generating criterion information based on an outdoor temperature, a room temperature of a space subjected to air-conditioning, and history information regarding an operation of the air-conditioning apparatus, the criterion information being information used for switching an operation mode of the air-conditioning apparatus between a first operation mode and a second operation mode, the first operation mode being configured to take an influence of the outdoor temperature into consideration, the second operation mode being configured not to take the influence of the outdoor temperature into consideration, an air-conditioning load of an operation in the second operation mode being larger than an air-conditioning load of an operation in the first operation mode; and executing a control process when the air-conditioning apparatus performs air-conditioning in the space, the control process including performing control for switching the operation mode of the air-conditioning apparatus to the first operation mode or the second operation mode based on the outdoor temperature, the room temperature of the space, and the criterion information.

2. The control method according to claim 1, wherein the generation process is configured to generate the criterion information indicating first control when the room temperature is lower than the outdoor temperature in the second operation mode, wherein the first control is configured to switch the operation mode to an operation mode having a larger air-conditioning load than an operation mode selected when the room temperature is higher than the outdoor temperature.

3. The control method according to claim 1, wherein the control process is configured to compare a first median value with a first room temperature in accordance with the criterion information, the first median value being a median value of room temperatures obtained in a morning in the past, the first room temperature being a room temperature at the time when the air-conditioning control is started, switch the operation mode of the air-conditioning apparatus to the first operation mode when the first room temperature is lower than the first median value, and switch the operation mode of the air-conditioning apparatus to the second operation mode when the first room temperature is higher than the first median value.

4. The control method according to claim 1, further comprising:

changing an operation capacity of a compressor included in the air-conditioning apparatus based on the air-conditioning load of the first or second operation mode to which the operation mode of the air-conditioning apparatus is switched, and executing air-conditioning control in the space.

5. The control method according to claim 1, wherein the generation process is configured to generate the criterion information so that when the air-conditioning control performed by the air-conditioning apparatus is cooling, the second operation mode has a larger air-conditioning load than the first operation mode, and when the air-conditioning control performed by the air-conditioning apparatus is heating, the first operation mode has a larger air-conditioning load than the second operation mode.

6. A control apparatus co p sing:

a memory; and a processor coupled to the memory, the processor being configured to execute a generation process that includes generating criterion information based on an outdoor temperature, a room temperature of a space subjected to air-conditioning, and history information regarding an operation of the air-conditioning apparatus, the criterion information being information used for switching an operation mode of the air-conditioning apparatus between a first operation mode and a second operation mode, the first operation mode being configured to take an influence of the outdoor temperature into consideration, the second operation mode being configured not to take the influence of the outdoor temperature into consideration, an air-conditioning load of an operation in the second operation mode being larger than an air-conditioning load of an operation in the first operation mode; and execute a control process when the air-conditioning apparatus performs air-conditioning in the space, the control process including performing control for switching the operation mode of the air-conditioning apparatus to the first operation mode or the second operation mode based on the outdoor temperature, the room temperature of the space, and the criterion information.

7. The control apparatus according to claim 6, wherein the generation process is configured to generate the criterion information indicating first control when the room temperature is lower than the outdoor temperature in the second operation mode, wherein the first control is configured to switch the operation mode to an operation mode having a larger air-conditioning load than an operation mode selected when the room temperature is higher than the outdoor temperature.

8. The control apparatus according to claim 6, wherein the control process is configured to compare a first median value with a first room temperature in accordance with the criterion information, the first median value being a median value of room temperatures obtained in a morning in the past, the first room temperature being a room temperature at the time when the air-conditioning control is started, switch the operation mode of the air-conditioning apparatus to the first operation mode when the first room temperature is lower than the first median value, and switch the operation mode of the air-conditioning apparatus to the second operation mode when the first room temperature is higher than the first median value.

9. The control apparatus according to claim 6, wherein the processor is further configured to change an operation capacity of a compressor included in the air-conditioning apparatus based on the air-conditioning load of the first or second operation mode to which the operation mode of the air-conditioning apparatus is switched, and execute air-conditioning control in the space.

10. The control apparatus according to claim 6, wherein the generation process is configured to generate the criterion information so that when the air-conditioning control performed by the air-conditioning apparatus is cooling, the second operation mode has a larger air-conditioning load than the first operation mode, and when the air-conditioning control performed by the air-conditioning apparatus is heating, the first operation mode has a larger air-conditioning load than the second operation mode.

11. A non-transitory computer-readable storage medium storing a program which causes a processor to perform processing, the processing comprising:

executing a generation process that includes generating criterion information based on an outdoor temperature, a room temperature of a space subjected to air-conditioning, and history information regarding an operation of the air-conditioning apparatus, the criterion information being information used for switching an operation mode of the air-conditioning apparatus between a first operation mode and a second operation mode, the first operation mode being configured to take an influence of the outdoor temperature into consideration, the second operation mode being configured not to take the influence of the outdoor temperature into consideration, an air-conditioning load of an operation in the second operation mode being larger than an air-conditioning load of an operation in the first operation mode; and executing a control process when the air-conditioning apparatus performs air-conditioning in the space, the control process including performing control for switching the operation mode of the air-conditioning apparatus to the first operation mode or the second operation mode based on the outdoor temperature, the room temperature of the space, and the criterion information.

12. The non-transitory computer-readable storage medium according to claim 11, wherein the generation process is configured to generate the criterion information indicating first control when the room temperature is lower than the outdoor temperature in the second operation mode, wherein the first control is configured to switch the operation mode to an operation mode having a larger air-conditioning load than an operation mode selected when the room temperature is higher than the outdoor temperature.

13. The non-transitory computer-readable storage medium according to claim 11, wherein the control process is configured to compare a first median value with a first room temperature in accordance with the criterion information, the first median value being a median value of room temperatures obtained in a morning in the past, the first room temperature being a room temperature at the time when the air-conditioning control is started, switch the operation mode of the air-conditioning apparatus to the first operation mode when the first room temperature is lower than the first median value, and switch the operation mode of the air-conditioning apparatus to the second operation mode when the first room temperature is higher than the first median value.

14. The non-transitory computer-readable storage medium according to claim 11, wherein the processing further comprises:

changing an operation capacity of a compressor included in the air-conditioning apparatus based on the air-conditioning load of the first or second operation mode to which the operation mode of the air-conditioning apparatus is switched, and executing air-conditioning control in the space.

15. The non-transitory computer-readable storage medium according to claim 11, wherein the generation process is configured to generate the criterion information so that when the air-conditioning control performed by the air-conditioning apparatus is cooling, the second operation mode has a larger air-conditioning load than the first operation mode, and when the air-conditioning control performed by the air-conditioning apparatus is heating, the first operation mode has a larger air-conditioning load than the second operation mode.

* * * * *